United States Patent [19]

Inoue et al.

[11] Patent Number: 4,488,083

[45] Date of Patent: Dec. 11, 1984

[54] TELEVISION CAMERA TUBE USING LIGHT-SENSITIVE LAYER COMPOSED OF AMORPHOUS SILICON

[75] Inventors: Eiichi Inoue, Tokyo; Isamu Shimizu, Kanagawa, both of Japan

[73] Assignee: Fuji Photo Film Co., Ltd., Kanagawa, Japan

[21] Appl. No.: 259,221

[22] Filed: Apr. 30, 1981

[30] Foreign Application Priority Data

Apr. 30, 1980 [JP] Japan ..... 55-57587

[51] Int. Cl.[3] ..... H01J 31/38

[52] U.S. Cl. ..... 313/366; 313/386

[58] Field of Search ..... 313/366, 386, 385, 376, 313/473, 384; 357/2, 30, 59 A, 31

[56] References Cited

U.S. PATENT DOCUMENTS 4,255,686 3/1981 Maruyama et al. ..... 313/366

4,329,699 5/1982 Ishihara et al. ..... 357/2

*Primary Examiner*—David K. Moore

*Assistant Examiner*—K. Wieder

*Attorney, Agent, or Firm*—Sughrue, Mion, Zinn, Macpeak & Seas

[57] ABSTRACT

A television camera tube using a target comprising an electrically-conductive support, a blocking layer composed of a n-type amorphous silicon semiconductor, provided on the electrically-conductive support, and a light-sensitive layer composed of amorphous silicon provided on the blocking layer.

17 Claims, 14 Drawing Figures

TELEVISION CAMERA TUBE USING LIGHT-SENSITIVE LAYER COMPOSED OF AMORPHOUS SILICON

FIELD OF THE INVENTION

This invention relates to a television camera tube using a light-sensitive layer composed of amorphous silicon.

BACKGROUND OF THE INVENTION

A so-called vidicon using a photoconductive thin film has been put into practical use as a television camera tube. Studies have been extensively made to improve the characteristics of such photoconductive thin films. Furthermore, improvements in an electrode system including an electron gun have been under investigation. Useful application of vidicons have broadened to uses such as camera tubes for image-information due to the simple constitution and easy handling of vidicons.

An amorphous silicon thin film can be converted into either a p-type semiconductor or a n-type semiconductor by doping it with an impurity, these making it useful as a solar battery. This amorphous silicon thin film is advantageous due to it strong light absorption in the visible region, its high efficiency in the formation of good light carriers. Furthermore, it is a uniform thin film having a large surface area which can be easily produced. It is thus believed to be suitable as a photoelectric transfer material for photoimage recording.

Recently, a television camera tube using an amorphous thin film has been developed, but it has not yet succeeded in providing a sharp image [Cf. *The 12th Conference on Solid State Devices* (Tokyo) 1980, Page 97 et seq].

SUMMARY OF THE INVENTION

The object of this invention is to provide a television camera tube which produces a sharp image.

This invention provides a television camera tube using a target which is prepared by providing a blocking layer comprising a n-type amorphous silicon semiconductor and a light-sensitive layer comprising amorphous silicon, usually having a conductivity (at 20° C.-25° C.) of less than $10^{-8}(\Omega\ cm)^{-1}$ on an electrically-conductive layer in that sequence.

Formation of a cover layer having an electron-retention action on the light-sensitive layer further increases the sharpness of an image.

DETAILED DESCRIPTION OF THE INVENTION

Figure 1:
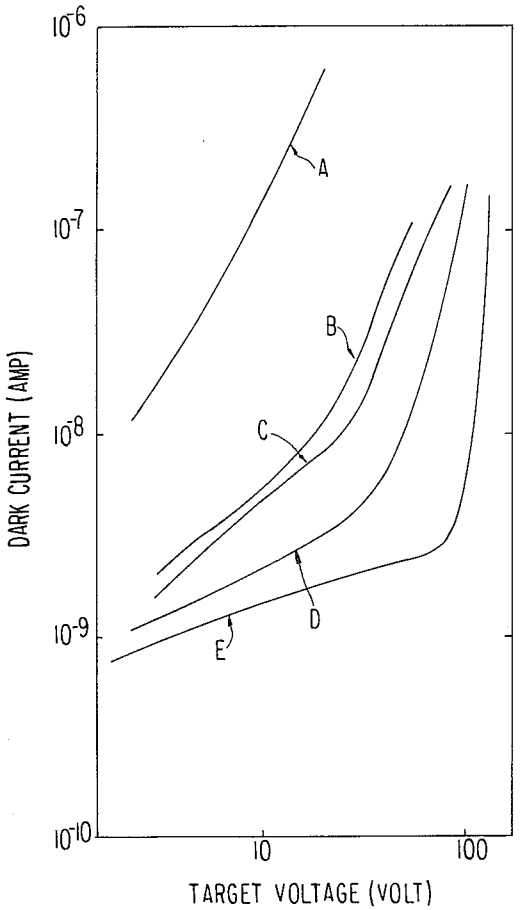
FIG. 1 shows the influences of blocking layers having varied thicknesses on the dark current-target voltage relation.

In general, any electrically-conductive support used in conventional vidicons can be used in this invention.

For example electrically-conductive supports prepared by providing a layer of an electrically-conductive substance, such as $SnO_2$, $In_2O_3$, and CdO, $(SnO_2)_x(In_2O_3)_{1-x}(0<X\leqq 1)$, which are used as transparent electrodes, on a transparent insulative material made of glass or plastics, which is used as a face plate of a target, can be used.

The thickness of the layer of the electrically-conductive substance is generally from about 0.005μ to about 10μ and preferably from about 0.01μ to about 0.2μ. This layer can be formed by providing $SnO_2$, $In_2O_3$, etc. on the face plate by sputtering, vacuum deposition, and so forth. Layer of compounds of $SnO_2$, etc., can be provided by methods such as spraying.

The blocking layer as used herein constitutes a barrier against electrons and/or electron hole carriers, i.e., the layer prevents the injection of electric charges from the electrically-conductive support into the light-sensitive layer. In accordance with this invention, by providing a n-type amorphous silicon layer as the blocking layer between the electrically-conductive support (electrode side) and the light-sensitive layer, a sharp image can be obtained.

The conductivity ($\delta_{RT}$) of the blocking layer (at 20° C. to 25° C.) is approximately $10^{-8}(\Omega\ cm)^{-1}$ or more, preferably about $10^{-7}(\Omega\ cm)^{-1}$ or more and most preferably about $10^{-5}(\Omega\ cm)^{-1}$ or more. When the conductivity is less than $10^{-8}(\Omega\ cm)^{-1}$, the electric charge injection-preventing effect is insufficient.

The thickness of the blocking layer is preferably as small as possible. However, the blocking layer will generally have a thickness of 50 Å or more, preferably from about 100 Å to about 1μ. When the thickness is less than 50 Å, the electric charge injection-preventing effect is not sufficient. On the other hand, when it is more than 1μ, the proportion of light reaching the amorphous silicon of the light-sensitive layer is greatly reduced.

In order to obtain a high photoconductive gain over the whole visible region, a blocking layer having a thickness of less than about 0.1μ is used.

The blocking layer can be provided on an electrode layer of the electrically-conductive layer by known methods, such as glow discharge decomposition, sputtering, and ion-plating.

The n-type amorphous semiconductor layer used as the blocking layer is preferably composed of an amorphous silicon containing about 0.1 to 40 atomic % of hydrogen. Additionally, amorphous silicon containing about 0.1 to 5 atomic % of hydrogen and about 0.01 to 20 atomic % of F, Cl or I can be used. An amorphous silicon layer having extremely small number of defects in the atomic structure is obtained when F is incorporated with hydrogen therein. In some cases, the blocking layer of this invention may contain P, As, Sb, Bi or N as impurity atoms.

Hereinafter, a method of producing the blocking layer will be explained by reference to glow discharge decomposition.

In accordance with this method, a compound containing silicon is decomposed by glow discharge and amorphous silicon is deposited on a substrate. Examples of useful silicon compounds include compounds represented by the general formula: $SiH_xX_{4-x}$ (wherein X is F, Cl or I, and x is an integer of 0 to 4), such as $SiH_4$, $SiF_4$, $SiHF_3$, $SiH_3Cl$, $SiH_2Cl_2$, $Si_2H_6$, or a mixture thereof. Of these silicon compounds $SiH_4$, $Si_2H_6$ and $SiF_4$ are preferable because they provide a layer having excellent electric characteristics. The silicon compounds are usually used in the form of gas. They may be used in pure form or diluted with an inert gas, such as Ar, He, Xe, etc. or $H_2$; usually to a concentration of about 5 to 50 mol%. When using a silicon compound containing no hydrogen, it is necessary to use hydrogen in combination with the silicon compound. The gas pressure of a vessel in which glow discharge is performed in generally from about $10^{-2}$ to 10 Torr. The current between the electrode and the substrate may be a DC current, an AC current or superposed current. When the AC current is used, a useful frequency is from about 1 Hz to about 4,000 MHz.

Useful doping agents include compounds containing impurity atoms, such as $NH_3$, $PH_3$, $AsH_3$, $SbCl_3$ and $BiCl_3$. $PH_3$ is preferred from a standpoint of handling because it is in gaseous form at ordinary temperature. The amount of the doping agent fed to the glow discharge apparatus is about 0 to 20,000 ppm (by volume; hereinafter, all ppms are by volume), preferably about 100 to 3,000 ppm, based on the weight of the silicon compound. However, the amount of doping agent fed varies depending on the substrate temperature. The substrate temperature is generally from about 200° C. to about 350° C. The weight ratio of impurity atoms to the silicon atoms in the thus-obtained blocking layer is nearly the same as that in the glow discharge apparatus.

The light-sensitive layer is preferably made of an i-type semiconductor wherein the Fermi level is present in nearly the center of band whose conductivity (at 20°-25° C.) is as small as possible, i.e., usually, about $10^{-8}$ $(\Omega\ cm)^{-1}$ or less and preferably $10^{-9}$ $(\Omega\ cm)^{-1}$ or less. In such semiconductors, there are a small number of defects in the atomic structure, and the average localized density is about $10^{17}/cm^3$ or less. When a light-sensitive layer having a conductivity of about $10^{-8}$ to $10^{-13}$ $(\Omega\ cm)^{-1}$ is used, the effect of this invention is prominently exhibited. Even if the light-sensitive layer used has a conductivity of less than $10^{-13}$ $(\Omega\ cm)^{-1}$, the blocking layer can be provided thereon.

The thickness of the light-sensitive layer is generally from about 0.5μ to about 10μ and preferably from about 1.5μ to about 5μ.

The light-sensitive layer can be provided on the blocking layer in the same manner that the blocking layer is provided on the electrically-conductive support. The amounts of hydrogen, F, Cl, and I in the amorphous silicon semiconductor can be selected from the same ranges as in the blocking layer. The light-sensitive layer contains no impurities, or contains small amounts of impurity atoms, such as P, As, Sb, Bi, and N, as in the case of the blocking layer. Furthermore, it may contain small amounts of impurity atoms, such as B, Al, Ga, In and Tl, as impurities.

When the light-sensitive layer is produced by glow discharge, compounds, such as $B_2H_6$, $BCl_3$, $BBr_3$, $BF_3$, $AlCl_3$, $GaCl_3$ and $InCl_3$, are used. Of these compounds, boron compounds are preferred from a stand point of operation because it is in the form of gas at ordinary temperature. The amount of the compound fed to the glow discharge apparatus is from about 0.1 to about 100 ppm, preferably from about 2 to about 50 ppm, based on the weight of the silicon compound, although it varies depending on the substrate temperature. The weight ratio of impurity atoms to the silicon atoms in the thus-obtained light-sensitive layer is nearly the same as that in the glow discharge apparatus.

The substrate temperature is generally from about 200° C. to about 350° C.

By providing the blocking layer in the camera tube using the light-sensitive layer composed of the amorphous silicon semiconductor, a sharp image can be obtained. The sharpness of the image can be further increased by providing a cover layer on the light-sensitive layer. The cover layer increases the electron retention ability of the camera tube upon the scanning of electron beams.

The cover layer is made of a substance having a high specific resistance, usually at least $10^{12}$ Ω cm, having a low electron mobility, usually less than $10^{-4}$ $cm^2$/volt.-sec and preferably having a low light absorption in the visible region. Examples of such substances which can be used include amorphous chalcogen, such as Se; amorphous chalcogenide, such as As-Se-S, Ge-S, Ge-Se, Sb-S, As-S, As-Se, and As-S based ones, e.g., $Sb_2S_3$, $As_2Se_3$, and $As_2Se_{1.5}Te_{1.5}$, and amorphous substances, such as $SiO_2$, SiO, $Al_2O_3$, $ZrO_2$, $TiO_2$, $MgF_2$, ZnS, and Si-C, Si-C-F, Si-N, and Si-N-O based substances. Of these compounds, amorphous chalcogenides are preferred for retaining electrons at the surface thereof, which can be attained because of their small electron mobility and large hole mobility. Furthermore, they are preferred because of smoothness of transfer of photoholes generated from the interior of the light sensitive layer upon exposure to light.

The thickness of the cover layer is usually from about 0.005μ to about 50μ and preferably from about 0.05μ to about 1μ. The cover layer can be provided on the light-sensitive layer by glow discharge, vacuum deposition, sputtering or like methods.

The following examples are given to illustrate this invention in greater detail.

EXAMPLE 1

A blocking layer composed of amorphous silicon containing therein P as an impurity was provided on an electrically-conductive support (prepared by providing a 0.1μ thick $In_2O_3$ layer on a glass plate having a diameter of 2.5 cm) by glow discharge. A 2μ thick light-sensitive layer composed of amorphous silicon was provided on the blocking layer. Using the thus-obtained target, a conventional vidicon was prepared.

The blocking layer having a thickness shown in Table 1 was produced using a $SiH_4$ gas containing therein $PH_3$ in a proportion shown in Table 1. The substrate temperature was 300° C.

The light-sensitive layer was provided on the blocking layer, using $SiH_4$ gas containing therein 250 ppm of $PH_3$ at a substrate temperature of 300° C. For comparison, a sample with no blocking layer provided thereon was produced.

The dark current ($i_d$) was measured by changing the target voltage ($V_t$), and the results are shown in FIG. 1. In FIG. 1, Curves A to E indicate the $i_d$-$V_t$ relation of Samples A to E, respectively.

TABLE 1

| Sample | Concentration of $PH_3$ in $SiH_4$ (ppm) | Thickness of Blocking Layer (μm) |
|---|---|---|
| A | no blocking layer | 0 |
| B | 250 | 0.05 |
| C | 50 | 0.2 |
| D | 400 | 0.2 |
| E | 250 | 0.2 |

From the results shown in FIG. 1, it can be seen that where no blocking layer is provided, the dark current is very large. The dark current can be reduced by providing the blocking layer of this invention. These sample clearly show that the concentration of $PH_3$ and the thickness of the blocking layer have strong influences on the $i_d$-$V_t$ relation.

EXAMPLE 2

Using a $SiH_4$ gas containing 250 ppm of $PH_3$, a blocking layer composed of amorphous silicon having a thickness shown in Table 2 was provided on an electrically-conductive support. The support was produced by providing a 0.1μ thick electrode layer composed of $In_2O_3$ on a glass plate having a diameter of 2.5 cm, by glow discharge at a substrate temperature of 300° C. On the blocking layer was provided a light-sensitive layer composed of amorphous silicon having a thickness shown in Table 2 by glow discharge at a substrate temperature of 300° C. using a $SiH_4$ gas containing therein 10 ppm of $B_2H_6$.

A cover layer as shown in Table 2 was provided on the above-produced light-sensitive layer by vacuum deposition. The cover layer of Sample No. 5 was provided by glow discharge at a substrate temperature of 150° C. using a $SiH_4$ gas. The cover layer of Sample No. 9 was provided by glow discharge at a substrate temperature of 300° C. using a $SiH_4$ gas containing therein 250 ppm of $B_2H_6$.

TABLE 2

| | Constitution of Vidicon | | |
|---|---|---|---|
| Sample No. | Cover Layer [Thickness (μm)] | Thickness of Light-sensitive Layer (μm) | Thickness of Blocking Layer (μm) |
| 1 | a-Se (0.28) | 2.8 | 0.2 |
| 2 | a-$As_2Se_3$ (0.32) | 2.8 | 0.2 |
| 3 | a-$As_2Se_{1.5}Te_{1.5}$ (0.44) | 2.8 | 0.2 |
| 4 | $Sb_2S_3$ (0.08) | 2.8 | 0.2 |
| 5 | a-Si (0.2) | 4.0 | 0.2 |
| 6 | none | 4.0 | 0.2 |
| 7 | a-$As_2Se_{1.5}Te_{1.5}$ (0.46) | 2.9 | 0.1 |
| 8 | a-$As_2Se_{1.5}Te_{1.5}$ (0.40) | 3.0 | 0.05 |
| 9 | p-type a-Si (0.01) | 3.0 | 0.1 |

Note:
The symbol "a" indicates that the substance is amorphous.

The thus-obtained target was measured with respect to various characteristics.

A. Dark Current Characteristics

Figure 8:
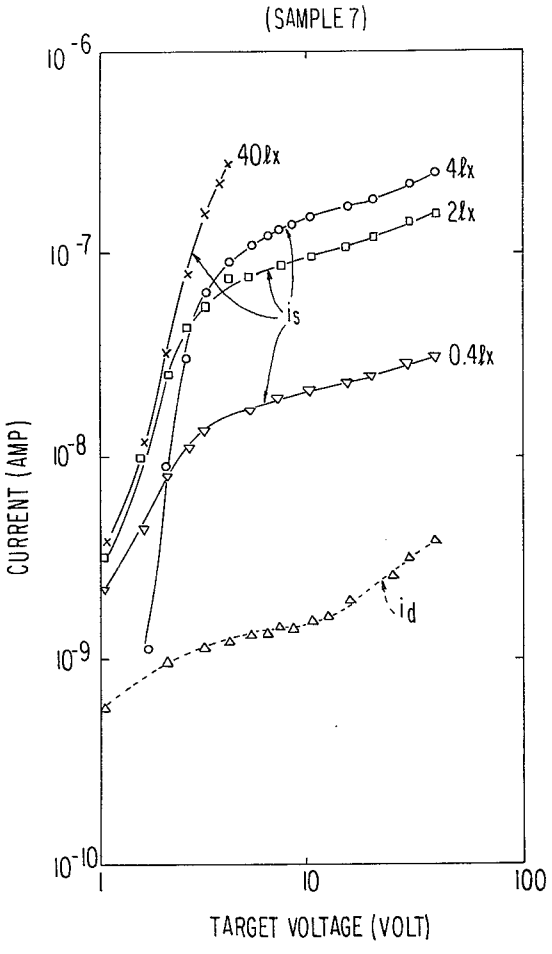
Figure 9:
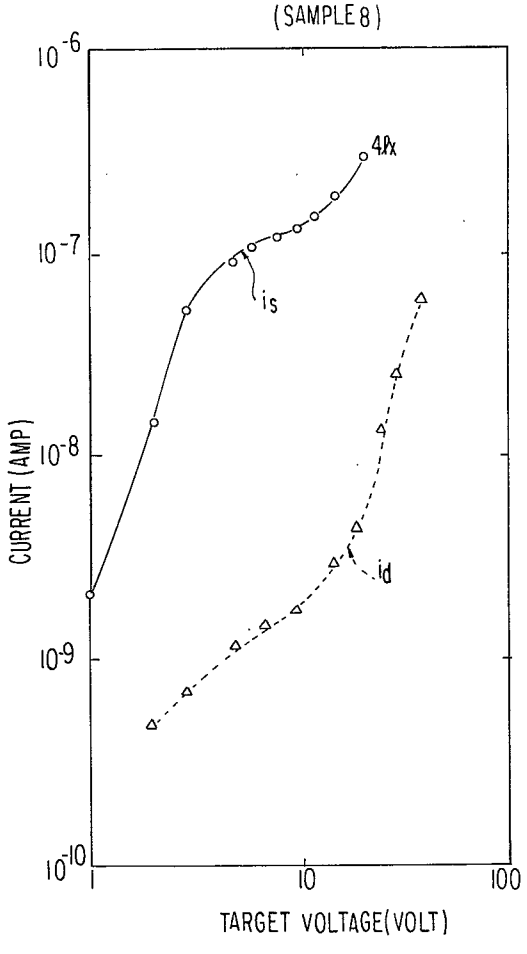

A comparison of Samples 7 and 8 is shown in Table 2 with respect to the $i_d$-$V_t$ relation (FIGS. 8 and 9) which indicates that when the thickness of the blocking layer is decreased, the increase in the $i_d$-value at the same $V_t$-value becomes prominent. This indicates that the blocking layer is effective in inhibiting the dark current. When the thickness of the blocking layer about 0.1 μm and $V_t<80$, it is possible to maintain the $i_d$-value at about 5 nA or less.

Figure 6:
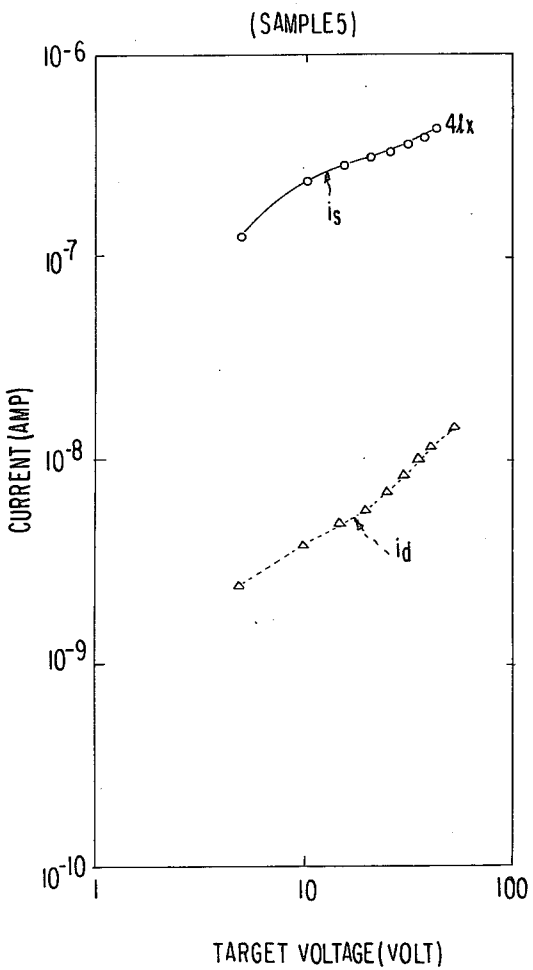
Figure 7:
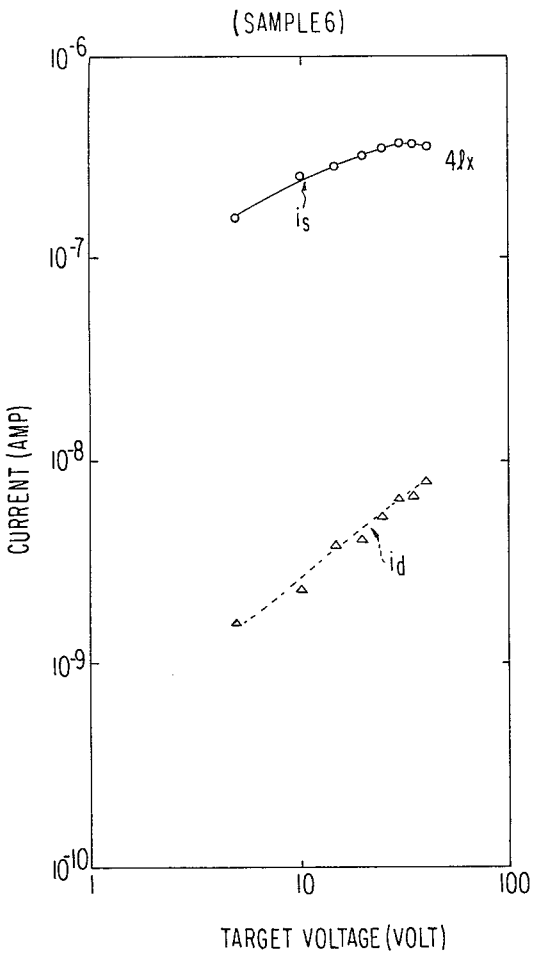
Figure 10:
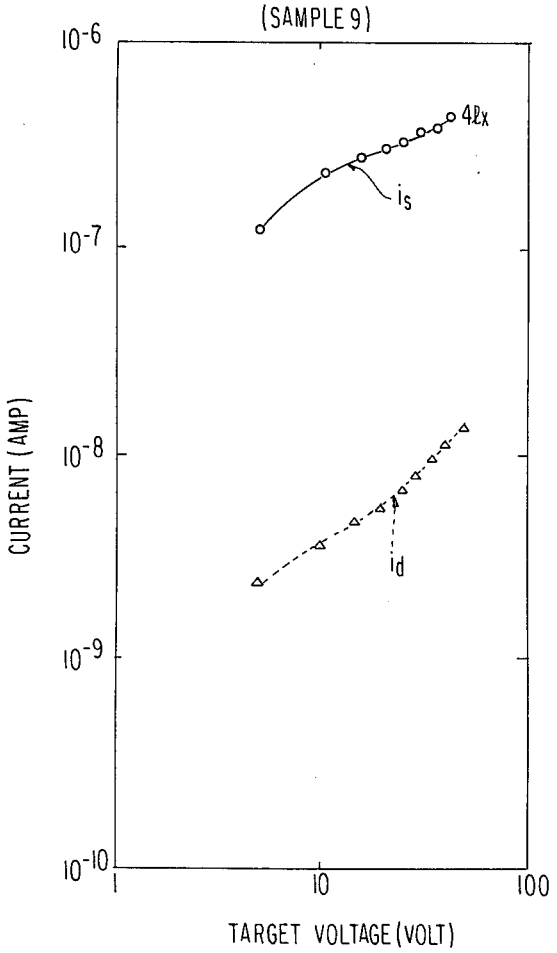

The results of Samples 5, 6 and 9 (FIGS. 6, 7 and 10) and other samples with respect to the $i_d$-$V_t$ relation show that there is no special difference in the $i_d$-$V_t$ characteristics, resulting from the presence of the cover layer. However, with the light-sensitive medium of Sample 6 having no cover layer, the sharpness of the image obtained is insufficient.

Figure 2:
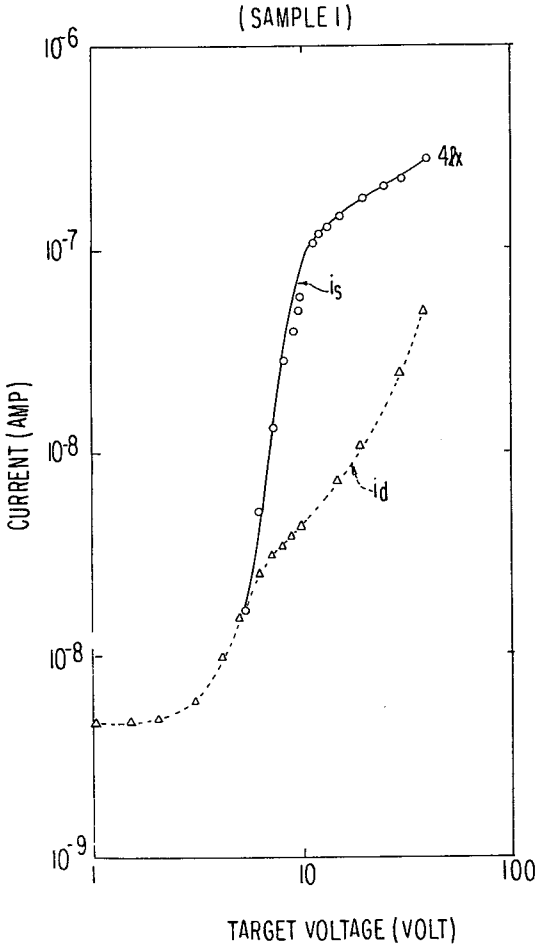
FIGS. 2 to 10 show the dark current-target voltage or signal current-target voltage relation of Samples 1 to 9 shown in Table 2.
Figure 3:
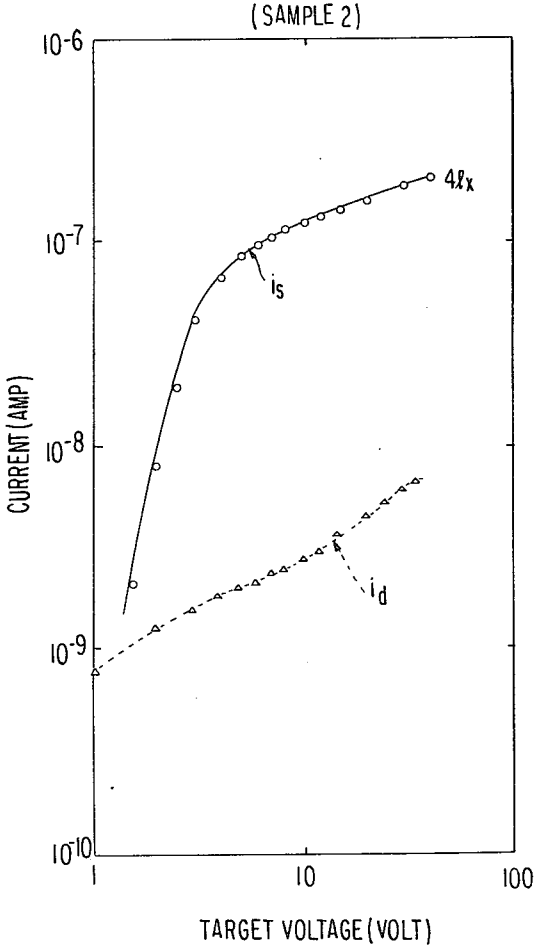
Figure 2:
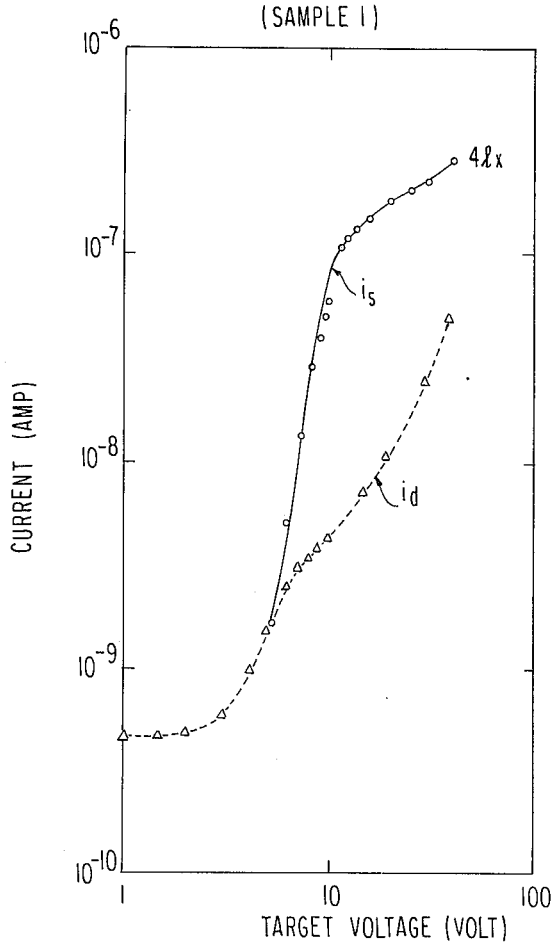
Figure 14:
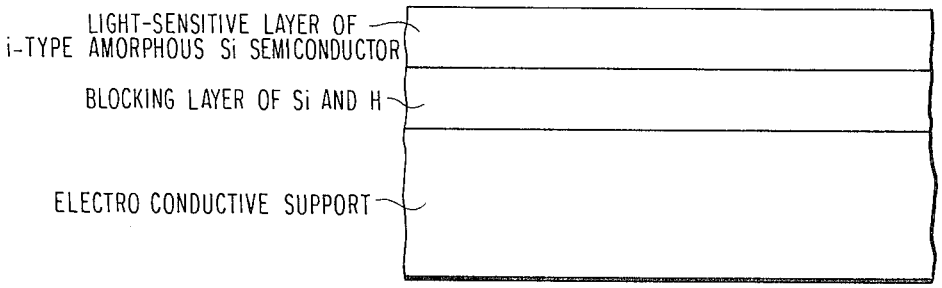
FIG. 14 shows an exploded cross section of the target of the present invention.
Figure 4:
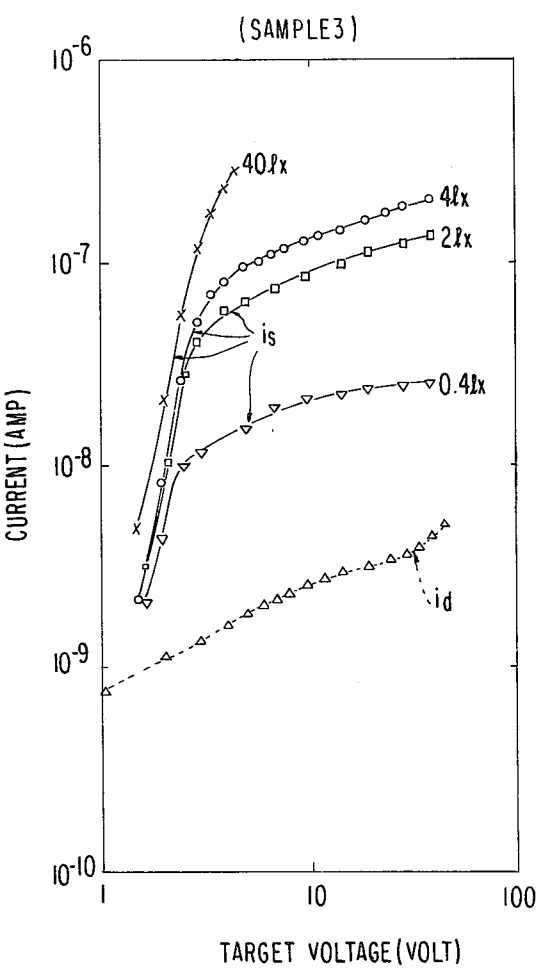
Figure 5:
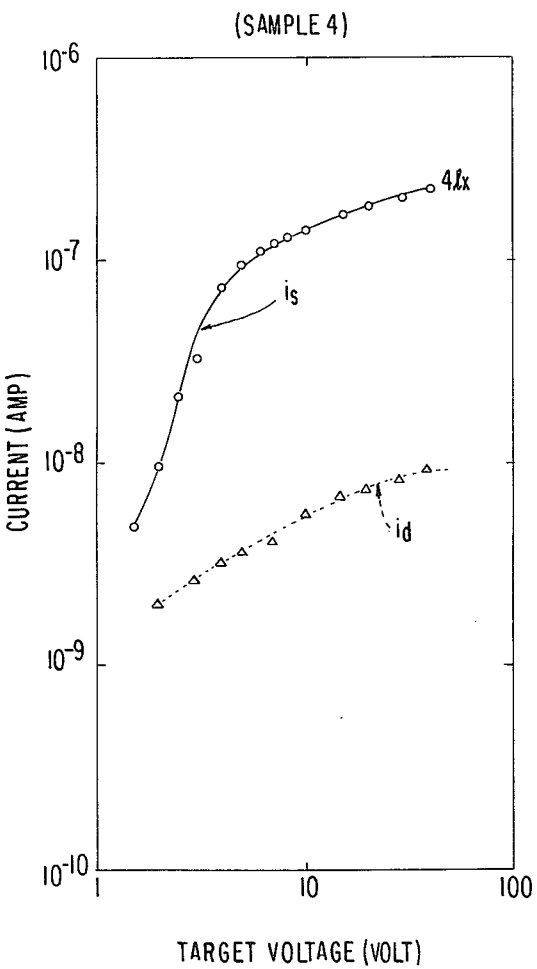

In Sample 1 (FIG. 2) using a-Se and, it is observed that the $i_d$-value abruptly increases with an increase in the $V_t$-value; furthermore, as compared with other samples, its dark current is high, and its effect as a cover layer is small.

Where a-$As_2Se_3$, a-$As_2Se_{1.5}Te_{1.5}$ and $Sb_2S_3$ are used in the cover layer (Samples 2, 3, 4, 7 and 8), the $i_d$-value gradually increases with an increase in the $V_t$ value up to about 50 volts (as can be seen in FIGS. 3, 4, 5, 8 and 9); and the image obtained is sharp. Thus, it can be seen that the effect as a cover layer of layers composed of such compounds is prominent. This is because these compounds exhibit p-type semiconductor characteristics having an extremely small electron mobility, thereby effectively inhibiting the injection of electrons from the surface.

B. Signal Current Characteristics

One of the features of the camera tube of this invention resides in the $i_s$-$V_t$ characteristics shown in the accompanying drawings. In any samples, the $i_s$-value abruptly increases with an increase in the $V_t$-value from a low $V_t$-value (about 1 volt) under irradiation with light. Thereafter the $i_s$-value moderately increases with an increase in the $V_t$-value. The relation between the $i_s$- and $V_t$-values after the abrupt increase in the $i_s$-value can be indicated as follows:

$$i_s \propto V_t^n \ (n<0.3)$$

Thus, it can be seen that the increase in the $i_s$-value is significantly small. This suggests that photo carriers formed in the light-sensitive layer are transferred under an emission-limited condition and neutralize surface electric charges at a very high efficiency. Therefore, by utilizing a light-sensitive medium having comprised in this manner, faint images appear sharp due to increased sensitivity.

Furthermore, since the μt-value (μ: mobility; t: life time of carrier) of the photo-hole formed in the a-Si light-sensitive layer, is about $10^{-7}$ cm²/volt, when the film thickness is about 10 μm or less, the carrier can be sufficiently transferred at a voltage of about 1 to 2 volts. However, as in the case of Sample 1 using a-Se, if blocking by the cover layer is insufficient, application of the effective electric field is prevented and space electric charges are formed, and, therefore, the transfer of photo carriers is hindered. Furthermore, since recombination of photo carriers is accelerated, the life of photo carrier is shortened, and as a result, the $i_s$-value is markedly reduced and the sensitivity is reduced (see FIG. 2).

The light-sensitive media of Samples 2 to 7 and 9 have similar characteristics which are shown in FIGS. 3 to 8 and 10, although there is slight differences. They all meet the emission-limited photocarrier transfer conditions.

Figure 11:
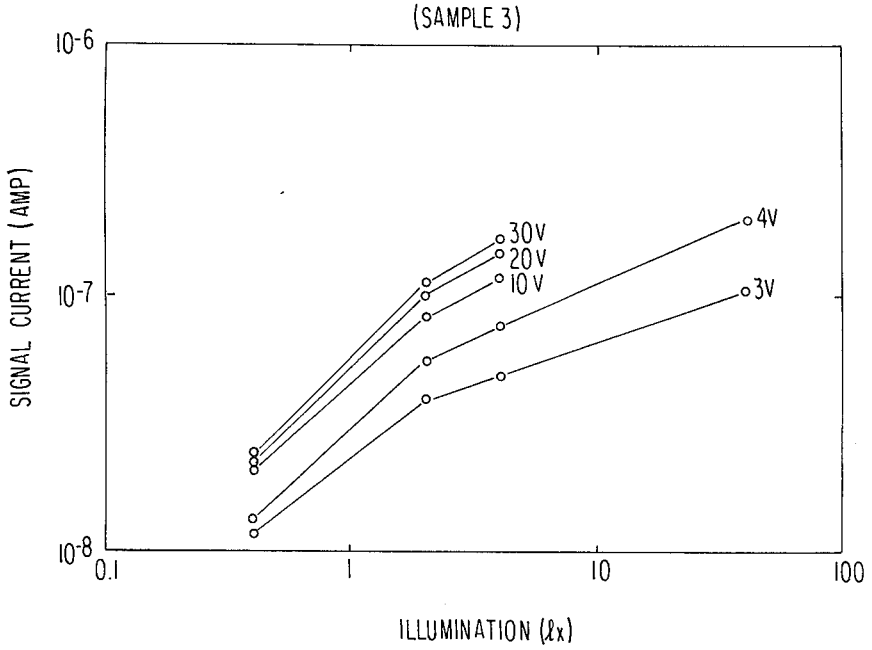
FIGS. 11 and 12 show the relation between the illumination of photoelectric surface and the signal current.
Figure 12:
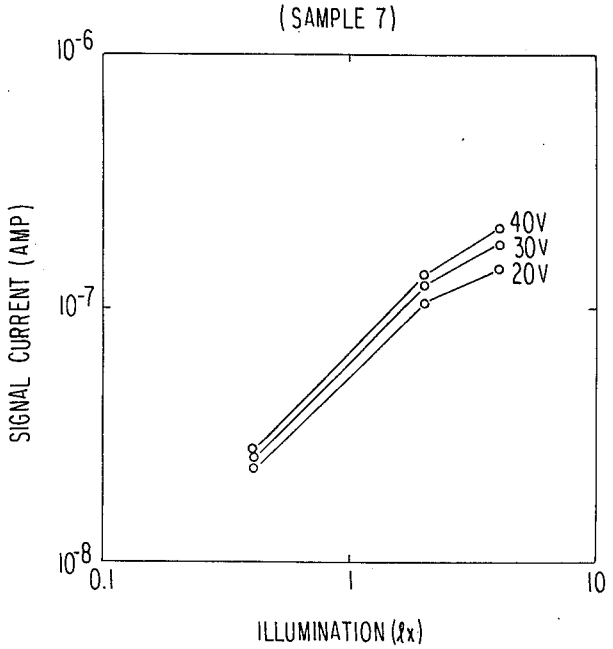

In order to confirm the foregoing fact, the dependence of the $i_s$-value on the light intensity of Samples 3 and 7 are shown in FIGS. 11 and 12, respectively. In each case, it can be seen that the $i_s$-value increases nearly in proportion to the intensity of incident light (F lux/cm²). This suggests not only that the transfer step of photo carriers is an emission-limited step, but also that the imaging function of the light-sensitive medium of this invention is excellent.

C. Light-sensitive Wave Length Characteristics

With regard to Sample 3, the relation between the wavelength of irradiated light and the photoconductive gain ($G=J_p/eN_o$ wherein $J_p$ is light current per unit area, e is a charge amount of an electron, and $N_o$ is the number of photons entering a unit area per unit time)

Figure 13:
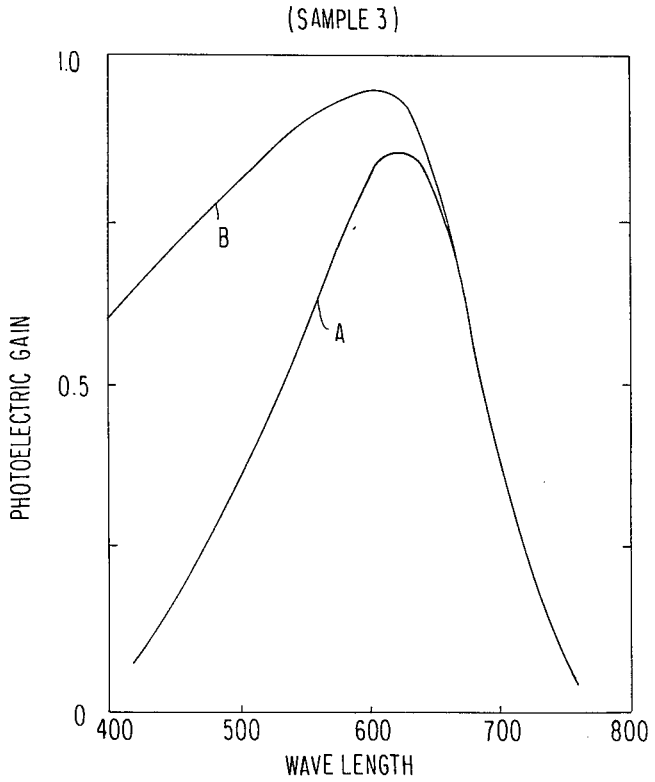
FIG. 13 shows the photoelectric gain of Sample 3.

($V_t$=30 V) is shown in FIG. 13. The optical band gap of a-Si is 1.6 eV and the wavelength (λ) corresponds to about 775 nm, and in the visible wavelength region (400 to 700 nm), it is maintained at a sufficiently high level. When the thickness of the cover layer is 0.2 μm (Curve A in FIG. 13), high sensitivity is maintained at green-red light. However, there is observed a reduction in the sensitivity to blue light wherein λ is 400 to 500 nm. This reduction in sensitivity is due to the fact that the absorption of light in the blocking layer does not efficiently contribute to the light current. Therefore, in order to obtain a high photoconductive gain over the whole visible region, it is necessary to reduce the film thickness of 0.1 μm or less. Curve B of FIG. 13 indicates the relation between the wavelength of irradiated light and the photoconductive gain in Sample 3 wherein the thickness of the blocking layer is 0.1 μm.

D. Camera Tube Characteristics

Of all the various camera tube characteristics, such as resolving power, after image and printing effect, those with a chalcogenide thin film provided thereon as a cover layer are most superior.

On the other hand, those having a cover layer composed of chalcogenide are superior in image resolving properties to Samples 5, 6 and 9. The a-Si cover layer is not so good in image resolving properties.

The photoconductive thin film having the blocking layer of this invention have the following advantages:

(1) The dark current is significantly small.
(2) The signal current is large, and the sensitivity is high.
(3) A large signal current is obtained in the region where the target voltage is low.
(4) The signal current is nearly in proportion to the intensity of incident light.
(5) The light-sensitive wavelength region can be made to cover the whole of the visible region.
(6) The production is easy; there is no danger of pin holes; and in respect of cost and mass production, it is advantageous over conventional target materials.
(7) The heat characteristics (heat resistance) are good.
(8) A good (sharp) image can be picked up.

What is claimed is:

1. A television camera tube using a target which comprises an electrically-conductive support, a blocking layer composed of an n-type amorphous silicon semiconductor consisting essentially of silicon and hydrogen, provided on the electrically-conductive layer, and a light-sensitive layer composed of an i-type amorphous silicon semiconductor having a conductivity of not more than $10^{-8}$ (Ω cm)$^{-1}$, provided on the blocking layer.

2. The television camera tube as in claim 1, wherein a cover layer having an electron retention action is provided on the light-sensitive layer composed of amorphous silicon.

3. The television camera tube as in claim 1 or 2, wherein the conductivity of the blocking layer is more than about $10^{-8}$ (Ω cm)$^{-1}$.

4. The television camera tube as in claim 1 or 2, wherein the thickness of the blocking layer is not less than about 50 Å.

5. The television camera tube as in claim 1 or 2, wherein the thickness of the blocking layer is about 50 Å to 1μ.

6. The television camera tube as in claim 1 or 2, wherein the blocking layer is composed of amorphous silicon containing therein about 0.1 to 40 atomic % of hydrogen.

7. The television camera tube as in claim 1 or 2, wherein the blocking layer is composed of amorphous silicon containing therein about 0.1 to 5 atomic % of hydrogen, and further containing about 0.01 to 20 atomic % of F, Cl, or I.

8. The television camera tube as in claim 6, wherein the blocking layer further contains therein P, As, Sb, Bi or N atom as an impurity atom.

9. The television camera tube as in claim 7, wherein the blocking layer further contains therein P, As, Sb, Bi or N atom as an impurity atom.

10. The television camera tube as in claim 1 or 2, wherein the thickness of the light-sensitive layer is about 0.5 to 10μ.

11. The television camera tube as in claim 1, wherein the light-sensitive layer is composed of amorphous silicon containing therein P, As, Sb, Bi, N, B, Al, Ga, In or Tl as an impurity atom.

12. The television camera tube as in claim 2, wherein the cover layer is composed of a substance having an electron mobility of not more than about $10^{-4}$ cm$^2$/volt.sec.

13. The television camera tube as in claim 2, wherein the cover layer is composed of a substance having a specific resistance of not less than $10^{12}$ Ω cm.

14. The television camera tube as in claim 2, wherein the cover layer is composed of amorphous Se, amorphous cholgenide, $SiO_2$, SiO, $Al_2O_3$, $ZrO_2$, $TiO_2$, $MgF_2$, ZnS, or a Si-C, Si-C-F, Si-N, or Si-N-O based amorhous substance.

15. The television camera tube as in claim 2, wherein the thickness of the cover layer is about 0.005 to 50μ.

16. The telelevision camera tube as in claim 1 or 2 wherein the conductivity of the light sensitive layer composed of amorphous silicon is less than about $10^{-8}$ (Ω cm$^{-1}$).

17. The television camera tube as in claim 1 wherein the blocking layer further contains an impurity atom selected from the group consisting of P, As, Sb, Bi and N atoms.

* * * * *